United States Patent [19]

Kauhl et al.

[11] 4,200,077

[45] Apr. 29, 1980

[54] GLOW PLUG STRUCTURE

[75] Inventors: Günther Kauhl, Affalterbach; Hannes Pflug, Gerlingen; Leo Steinke, Waiblingen-Hegnach, all of Fed. Rep. of Germany

[73] Assignee: Robert Bosch GmbH, Stuttgart, Fed. Rep. of Germany

[21] Appl. No.: 942,045

[22] Filed: Sep. 13, 1978

[30] Foreign Application Priority Data

Oct. 15, 1977 [DE] Fed. Rep. of Germany ..... 2746595

[51] Int. Cl.[2] ..... H05B 3/00

[52] U.S. Cl. ..... 123/145 A; 29/612; 123/145 R; 361/266; 219/260; 219/270

[58] Field of Search ..... 123/145 A, 145 R, 325 P; 29/610, 611, 612, 613, 614, 615, 616, 617, 618, 619, 620; 361/266; 219/260, 270

[56] References Cited

U.S. PATENT DOCUMENTS

| | | | |
|---|---|---|---|
| 2,492,755 | 12/1949 | McCollum | 123/145 A |
| 2,672,546 | 3/1954 | Klingner et al. | 123/145 A |
| 2,831,951 | 4/1958 | Deslodge | 29/614 |
| 3,017,540 | 1/1962 | Lawser | 219/260 |
| 3,252,122 | 5/1966 | Baxter | 123/145 R |
| 3,440,589 | 4/1969 | Minks | 29/614 |
| 3,798,760 | 3/1974 | Carlson et al. | 29/614 |
| 3,812,580 | 5/1974 | Drugmand | 29/615 |
| 4,087,904 | 5/1978 | Steinke et al. | 361/266 |
| 4,112,577 | 9/1978 | Mann | 123/145 A |

*Primary Examiner*—Charles J. Myhre
*Assistant Examiner*—R. A. Nelli
*Attorney, Agent, or Firm*—Frishauf, Holtz, Goodman & Woodward

[57] ABSTRACT

To prevent damage to the heating wire of an electrically heated glow plug due to non-uniform expansion of materials within the glow plug upon heating thereof, and particularly due to excessive expansion of filler material surrounding a spiraled heating wire, the filler material is made in two sections, one being located within the spiral of the heater wire and comprising a material of a thermal conductivity of expansion approximately matching that of the heater wire, typically high-temperature annealed aluminum oxide, magnesium aluminum spinel, silicon nitride, boron nitride, silicon carbide, or the like, the outer section between the heater wire and the inner wall of the glow tube being of a material of good heat conductivity, such as magnesium oxide. In manufacture, the first material is introduced into the heater wire spiral in the form of a compacted rod which, after assembly to the tube and introduction of the second material, is crushed by diametrical reduction of the tube after closing thereof, for example by hammering, rolling or swaging.

6 Claims, 1 Drawing Figure

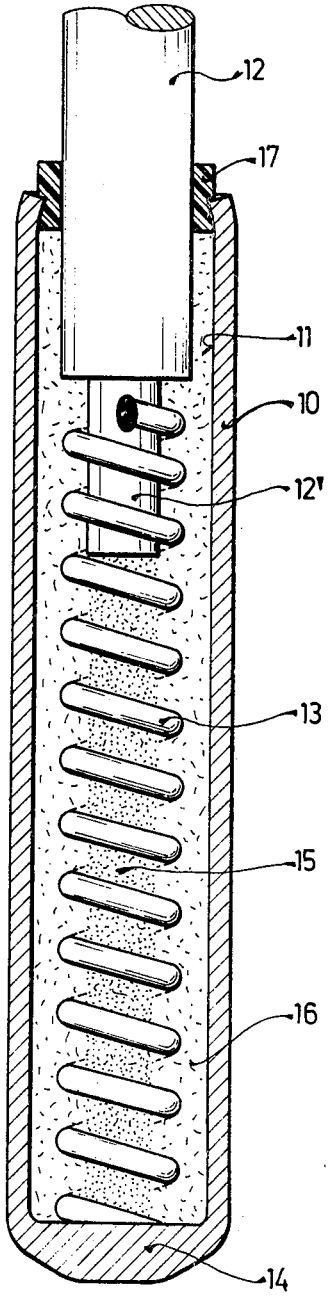
12
17
11
10
12'
13
15
16
14

GLOW PLUG STRUCTURE

The present invention relates to a glow plug structure, particularly to preheat the combustion space of automotive-type Diesel engines, and to a method of its manufacture.

BACKGROUND AND PRIOR ART

Various types of glow plugs have been proposed; one such type is described in U.S. Pat. No. 2,130,365. The present invention relates to this type of glow plug. This type of glow plug includes an electrical heating winding which is constructed as an elongated spiral made of molybdenum or tungsten wire embedded into an insulating, heat-conductive powder or granulate, typically magnesium oxide or aluminum oxide. If such a spiral heating wire is made of tungsten or molybdenum, and the embedding insulating material is made of magnesium oxide, it has been found that the heating wire spiral may tear since the thermal coefficient of expansion of magnesium oxide is substantially greater than that of tungsten or molybdenum, respectively. If, however, such heating wire spirals are embedded in aluminum oxide, then the preheating time needed by such preheating plugs or glow plugs is substantially increased due to the relatively poor heat conductivity of aluminum oxide. The increase in preheating time is unacceptable for modern automotive-type internal combustion engines.

THE INVENTION

It is an object to provide a glow plug which has the advantages of the relatively simple molybdenum or tungsten wire glow plugs, provides rapid preheat time, and is not subject to tearing or destruction due to highly different thermal coefficients of expansion of the materials used, and to provide a method for its manufacture on a rapid and economical basis.

Briefly, the glow plug uses a well known molybdenum or tungsten heating wire which is connected at one end to the closed end of the tubular housing of the glow plug and then extends in an axial spiral within the housing. The spiral of the heating wire is embedded in a dual filler material which is a composite having a first section located within the outline of the spiral and made of a material which has a thermal coefficient of expansion which at least approximately matches that of the heating wire—typically and preferably aluminum oxide—and which has a second section which surrounds the outer portion of the heating wire, that is, surrounds the heating wire between the outer surface and the inner wall of the glow plug tube, and which comprises a material which has a high heat conductivity—typically, and preferably, magnesium oxide.

Such a glow plug can be easily made by providing the first, or inner material in form of a compacted rod and introducing this compacted rod into the heater winding spiral, the heater winding spiral then being welded to the closed end of the glow plug. Thereafter, the magnesum oxide, or the heat conducting material whose primary characteristic is good heat conductivity, rather than match of thermal coefficient of expansion to that of the heating wire, is poured into the space between the heater wire—compacted insulating material subassembly and the inner wall of the glow tube, and vibrated to provide a compact unit. Thereafter, the outer circumference of the glow plug is reduced, for example by hammering, rolling, or the like, in order to compact both insulating materials together. In this operation, the rod-like first insulating material within the spiral is crushed. The heating spiral wire is not damaged thereby if the crushing operation is done with some care and not excessively; this hammering and rolling operation simultaneously compacts the insulating materials together.

Drawings, illustrating a preferred example, wherein the single FIGURE is a greatly enlarged longitudinal cross-sectional view of the portion of the glow plug which extends into the combustion chamber of an internal combustion engine.

The glow plug construction is applicable to the types of glow plugs described, for example, in general in German Pat. No. 1,119,598 as well as to glow plugs which additionally provide for fuel supply thereto described, for example, in German Pat. No. 1,301,631.

The glow plug has an glow tube 10 which is closed at the bottom at 14. The open end 11 has a connecting bolt 12 extending therethrough. The connecting bolt 12 has an extension pin 12' of reduced diameter. The upper end portion of the heating wire 13 is secured to the pin 12', for example by welding. The lower wall 14 of the glow plug is electrically and mechanically connected to the other end of the heating wire 13, for example also by welding. The region within the spiral of the heating wire 13 is filled with a first insulating material 15 which comprises high-temperature annealed aluminum oxide, that is, aluminum oxide which has been preheated to incandescence; the remaining space within the interior of the glow tube is filled by a second insulating material 16 which comprises magnesium oxide. The end portion of the glow tube 10 is held closed by a sealing ring 17 which is crimp-connected to the end portion 11 of the tube 10 and thus sealed tightly against bolt 12.

The insulating materials 15, 16 are thoroughly compacted, the glow plug having been hammered, rolled, or otherwise worked to effect a slight radial reduction. The heat conductivity between the heater winding 13 and the wall of the glow plug 10 thus is excellent.

The heater wire 13 need not be tungsten; molydenum may also be used. The first insulating material 15 need not be annealed aluminum oxide; one may also use, MgAl spinel, silicon nitride, boron nitride, or silicon carbide which have been annealed, preferably by having been heated to incandescence. The particular material used for the material 15 essentially must have the characteristic of being an insulating material, capable of being preformed, that is, compacted for manufacture, as will appear below, and additionally have a thermal coefficient of expansion which at least approximately matches that of the heating wire which, typically, is molybdenum or tungsten, but may be another material.

Manufacture of such a glow plug is relatively simple if the material 15 is first compacted as an elongated, compressed rod, which is introduced through the spiral windings 15, or over which the windings 15 are wrapped. After insertion of the insulating material 15 through the spirals 13, spirals 13 are secured to the pin-like extension 12' of bolt 12 by welding. The subassembly which is thus formed is introduced into the glow plug 10, and the end portion of the winding 13 is welded to the closed bottom 14 of the glow plug tube 10. The remaining free space within the interior of the glow plug 10 is then filled with the second insulating material 16 which is introduced under vibration and shaking; when full, and compactly so, the connecting end of the glow plug 10 is closed with a sealing ring 17 and the wall of tube 10 is crimped to engage into the sealing ring, as seen in the drawing. The now assembled glow plug is then radially reduced in diameter by hammering, rolling, swaging, or the like. Consequently, the rod-like compacted insulating material 15 is crushed. The reduction operation is so carried out that the heating wire 13 is not damaged. By reduction of the diameter, the insulating materials 15, 16 are tightly compacted and excellent heat conductivity between the wire 13 and the tube 10 of the glow plug is obtained.

The arrangement effectively prevents damage or destruction to a heating wire 13 made of molybdenum or tungsten due to differential thermal expansion between the material used for the heating wire and the insulating material surrounding the heating wire. As the glow plug heats, the insulating material 15 will expand. These forces will not, however, be in excess of the strength of the wire of the heating winding 13 itself. The second insulating material between the heating wire 13 and the glow plug 10 provides for good heat transfer between the heating wire 13 and the glow plug 10.

Various changes and modifications may be made within the scope of the inventive concept.

We claim:

1. Glow plug structure comprising a tubular housing (10) closed at one end (14) thereof;

a spiral heating wire (13) comprising at least one of: molybdenum; tungsten connected at one end to the closed end of the tubular housing and extending axially, spirally within the housing;

and a filler (15, 16) filling the housing and embedding the spiral heating wire therein, wherein, in accordance with the invention, the filler is radially compacted and comprises a first section (15) located within the outline of the spiral of the heating wire and made of a material having a thermal coefficient of expansion which at least approximately matches that of the heating wire;

and another section (16) filling the remaining space within the housing between the heater wire and the inner walls of the housing and made of a material having a good heat conductivity which is higher than that of the material of said first section.

2. Structure according to claim 1, wherein the first section of the insulating material (15) comprises at least one of the following annealed substances aluminum oxide; magnesium-aluminum spinel; silicon nitride; boron nitride; silicon carbide.

3. Structure according to claim 1, wherein the first section (15) of insulating material comprises annealed aluminum oxide.

4. Structure according to claim 1, wherein the second section of insulating material (16) comprises magnesum oxide.

5. Structure according to claim 2, wherein the second section of insulating material (16) comprises magnesium oxide.

6. Structure according to claim 3, wherein the second section of insulating material (16) comprises magnesium oxide.

* * * * *